United States Patent [19]

Tapp

[11] 4,393,536

[45] Jul. 19, 1983

[54] DUAL MODE VACUUM CLEANER

[76] Inventor: Ruel W. Tapp, P.O. Box 449, Tomball, Tex. 77375

[21] Appl. No.: 342,515

[22] Filed: Jan. 25, 1982

[51] Int. Cl.[3] ..... A47L 5/14

[52] U.S. Cl. ..... 15/327 C; 15/328; 15/335; 15/346

[58] Field of Search ..... 15/328, 330, 345, 346, 15/335, 336, 327 C, 327 E, 338

[56] References Cited

U.S. PATENT DOCUMENTS

| | | | |
|---|---|---|---|
| 2,210,950 | 8/1940 | Replogle | 15/335 X |
| 2,331,692 | 10/1943 | Hunt | 15/327 E X |
| 3,142,857 | 8/1964 | Fresard et al. | 15/330 X |
| 3,268,942 | 8/1966 | Rossnan | 15/346 |
| 3,310,828 | 3/1967 | Clark et al. | 15/328 |
| 4,373,228 | 2/1983 | Dyson | 15/346 X |

*Primary Examiner*—Chris K. Moore

*Attorney, Agent, or Firm*—Norman B. Rainer

[57] ABSTRACT

A canister-type vacuum cleaner is provided wherein the vacuum cleaner may be operated with the canister in either a horizontal or substantially upright position. When in the upright position, both vacuum and pressure effects are transmitted to a floor-cleaning device, whereby the cleaning efficiency of the floor-cleaning device is improved.

4 Claims, 4 Drawing Figures

DUAL MODE VACUUM CLEANER

BACKGROUND OF THE INVENTION

This invention relates to vacuum cleaners, and more particularly to cleaners of the tank or canister type in which a motor-fan unit and dust-separating means are contained within an elongated housing mounted on wheels or the like for movably supporting the housing on a horizontal surface such as a floor.

In the well known designs of canister vacuum cleaners, the opposed extremities of the canister are provided with a suction port and exhaust port. A flexible suction hose removably attaches to the suction port and to a rigid tube or wand, usually bent or curved, which in turn communicates with a suction cleaning tool. The hose serves the dual purpose of establishing a fluid connection between the cleaning tool and the canister, and of transmitting force to the canister for pulling it around on the floor.

In those applications where it is inconvenient or undesirable to pull the canister horizontally about the floor, other well known designs of vacuum cleaners, called "uprights" can be employed wherein the canister is mounted to a rigid, upwardly directed post pivotably associated with a carpet-sweeper type of suction cleaning tool adapted for rolling motion upon the floor.

Canister-type vacuum cleaners sufficiently versatile to permit the canister to operate in the horizontal, hose-dragged mode or in an upright mode have not heretofore been disclosed.

Floor-cleaning accessory devices in the nature of carpet-sweeper suction heads for use with vacuum cleaners are well known. Such heads are generally equipped with beater brushes driven by an electric motor. The effect of the beater brushes is to dislodge particulate matter, causing it to become suspended in the air stream flowing to the fan. The efficiency of such suction heads is usually dependent upon the amount of beating energy expended and the volume of the suction air flow, both factors having certain practical limitations.

It is accordingly an object of the present invention to provide a canister-type vacuum cleaner apparatus wherein said canister may be utilized in either a horizontal, hose-dragged mode, or in an upright mode attached to an upwardly directed rigid member.

It is another object of this invention to provide a vacuum cleaner and suction head combination wherein the efficiency of said suction head is increased without increasing the power of the motors which drive the fan or beater brushes.

These objects and other objects and advantages of the invention will be apparent from the following description.

SUMMARY OF THE INVENTION

The above and other beneficial objects and advantages are accomplished in accordance with the present invention by an improved vacuum cleaner which comprises an elongated canister which confines an electric motor, a fan or equivalent air-moving means driven by said motor, and filtration means adapted to remove particulate material from air moved through said canister by said air-moving means. One end of said canister is provided with an intake port, and the opposite end is provided with an exhaust port, both said ports being provided with coupling means to accommodate facile connection and disconnection of hoses. Means such as wheels or runners are mounted to the underside of the canister to facilitate movement over a horizontal surface. The upper side of said canister is provided with means for attachment to a rigid tubular member.

Two separate flexible conduits are provided, the first being intended to communicate between the intake port of the canister and the upper extremity of a rigid tubular member or "wand" which extends downwardly to engagement with a floor-cleaning device.

The floor-cleaning device is comprised of a housing which encloses a motor and rotary brushes driven by said motor. The underside of the floor-cleaning device is provided with wheels to facilitate rolling movement over carpets to be cleaned. A first port is provided in said housing as an exit port which couples with the lowermost extremity of said tubular member. A second port is provided in the housing, preferably at the top thereof to serve as an inlet port. The second flexible conduit, of shorter length than said first flexible conduit, extends between said second port and the exhaust port of said canister.

Connection of the second flexible conduit to said floor-cleaning device is intended to be accomplished only when the canister is attached to said rigid tubular member. In such mode of operation, the vacuum cleaner functions as an "upright" unit. The wheels on the underside of the canister may however rest on the floor to facilitate movement of the unit.

When in said upright mode, and with the second flexible conduit in communication with said floor-cleaning device, both the suction and exhaust streams generated by the fan are interactive within the floor-cleaning device. In a sense, it causes the vacuum cleaner to run on a closed circuit wherein the suction and exhaust streams form an essentially circuitous path. Such mode of action has been found to greatly enhance the cleaning efficiency of the floor-cleaning device. In a preferred embodiment, the exhaust stream from the fan enters downwardly into the floor-cleaning device while the suction stream passes horizontally through said floor-cleaning device.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
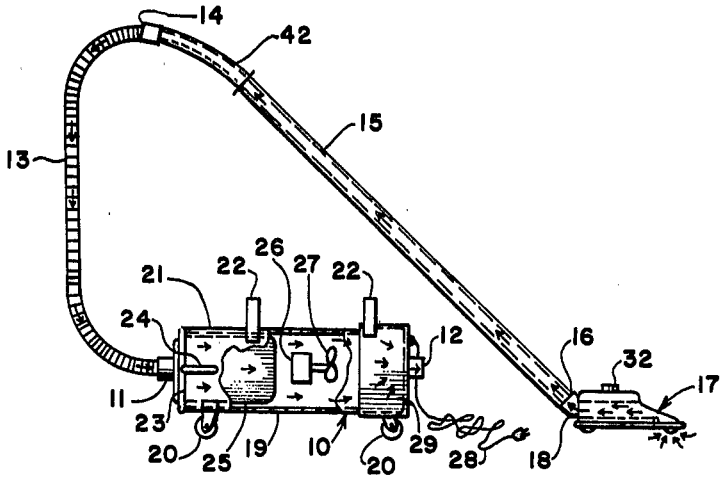
FIG. 1 is a schematic side view of the vacuum cleaner of this invention in its non-upright mode of utilization with parts broken away to reveal interior details.

Referring to FIG. 1, a vacuum cleaner of the present invention is shown comprised of elongated canister 10 having an intake or vacuum port 11 and exhaust port 12, said ports disposed at opposite extremities of said canister. A long flexible hose 13 engages vacuum port 11, and extends to engagement with the upper extremity 14 of rigid tube 15. The lower extremity 16 of said tube attaches to floor-cleaning device 17 by insertive engagement with exit port 18 positioned at the rear of said floor-cleaning device.

Mounted to the underside 19 of canister 10 are four caster-type wheels 20 arranged in spaced-apart rectangular configuration. The top side 21 of the canister contains attachment means in the form of spaced-apart clamps 22 which are adapted to securely engage tube 15 in a releasable manner. The extremity of said canister with which said vacuum port is associated contains a removable cover 23 onto which said vacuum port is mounted. Said cover 23 is held fast to the canister by paired lever clamps 24. A filter bag 25 is held within the canister, said bag being provided with a gasketed circular lip (not shown) which serves to make an air-tight seal between cover 23 and the outer perimeter of the canister. An electric motor 26 and associated fan blade 27 mounted on the spindle of said motor are positioned within the canister on the center axis thereof. An electric cord 28 is associated with the rear cover 29 of said canister and supplies electrical current to motor 26. Means may be provided in association with rear cover 29 for the winding and storage of said electric cord.

The long flexible hose in association with tube 15 creates a continuous conduit which conveys air from the lowermost extremity of said tube to vacuum port 11. Tube 15, which may be comprised of several sections interlocked by frictional or telescoping engagement, may contain a curved upper portion 42 adapted to serve as a manipulative handle. Said tube or portions thereof may also function as a carrying handle for the vacuum cleaner by engagement with clamps 22.

Figure 4:
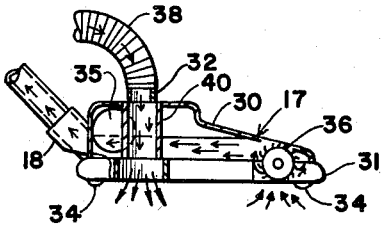
FIG. 4 is an enlarged sectional side view of the floor-cleaning device of FIG. 2.

As shown more clearly in FIG. 4, floor-cleaning device 17 is comprised of an upper casing or housing 30, and a bottom member 31 to the underside of which wheels 34 are attached for rolling motion over flat surfaces such as floors. An inlet port 32 is positioned in the upper surface of said casing. A vertical conduit 40, continuous with port 32, extends through bottom member 31. Exit port 18, positioned on the rear sidewall surface of the casing, serves as an exit port for air traveling toward the canister and serves to secure the lower extremity 16 of tube 15. An electric motor 35, and beater brushes 36 rotatively activated by said motor, are housed within the casing. Electrical current for operation of motor 35 may be provided via a separate conductor wire 39 extending from the canister, or by equivalent conductor means which may be associated with tube 15.

Figure 2:
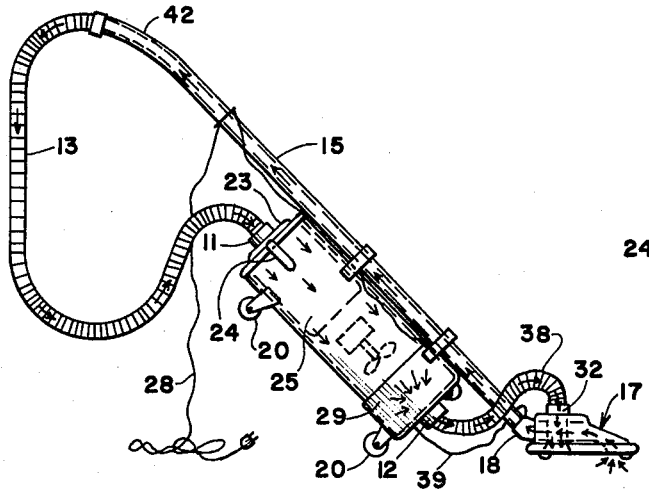
FIG. 2 is a schematic side view of the vacuum cleaner of this invention in its upright mode of utilization.
Figure 3:
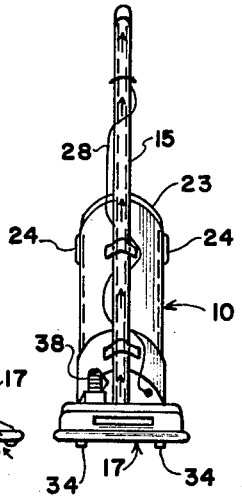
FIG. 3 is a front view of the upright mode of FIG. 2.

When the vacuum cleaner is operated in its upright mode, canister 10 is attached to the rigid tube 15 by clamps 22 in a manner such that exhaust port 12 of said housing is downwardly oriented, and front wheels 20 are adapted to roll on the same plane as wheels 34 of floor-cleaning device 17. A short flexible hose 38 communicates between exhaust port 12 of the canister and inlet port 32 of the floor-cleaning device. The air flow in the vacuum cleaner is as shown by the arrows in FIGS. 1, 2 and 4. As is indicated by the air flow pattern in FIG. 4, which represents operation of the vacuum cleaner in its upright mode, the downward flow of air from the exhaust port of the canister reinforces the upward flow of air adjacent the beater brushes and directed to vacuum port 11. Such enhancement of the air flow pattern provides more efficient suspension and transport of particulate material into filter bag 25.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A vacuum cleaner apparatus comprising (a) an elongated canister which confines an electric motor, air-moving means driven by said motor, and filtration means adapted to remove particulate material from air moved through said canister by said air-moving means, (b) front and rear closure means associated with each end of said canister, (c) a vacuum port positioned within said front closure means, (d) an exhaust port positioned within said rear closure means, (e) said vacuum and exhaust ports communicating with the interior of said canister and adapted to permit facile connection thereto of conduits, (f) means associated with the underside of said canister to facilitate movement over a horizontal surface, (g) means associated with the upper side of said canister for releasable attachment to a tubular member, (h) a rigid tubular member having first and second extremities, (i) a first flexible conduit adapted to communicate between said vacuum port and the first extremity of said tubular member, (j) a floor-cleaning device comprised of a housing which encloses a second electric motor and rotary brushes driven by said motor, means associated with the lowermost surface of said housing to facilitate movement over a horizontal surface, an inlet port positioned in the uppermost surface of said housing and communicating with a conduit which extends to an opening adjacent the lowermost surface of said housing, and an exit port positioned in a side surface of said housing, said exit port serving to engage the second extremity of said tubular member, (k) and a second flexible conduit, shorter than said first flexible conduit, adapted to attach at one end to said exhaust port and at its opposite end to said inlet port when said canister is attached to said rigid tubular member in a manner such that said front closure means is upwardly directed.

2. The apparatus of claim 1 wherein said means associated with the underside of said canister to facilitate movement over a horizontal surface are wheels.

3. The apparatus of claim 2 wherein said wheels are four in number and are disposed as a forward pair and a rearward pair.

4. The apparatus of claim 3 wherein said rearward pair of wheels are in rolling contact with the horizontal surface upon which said apparatus rests when said canister is attached to said tubular member and held in an upright configuration.

* * * * *